US011792559B2

(12) United States Patent
Liu et al.

(10) Patent No.: US 11,792,559 B2
(45) Date of Patent: Oct. 17, 2023

(54) EARPHONE CONTROL METHOD AND DEVICE, AND NON-TRANSITORY COMPUTER READABLE STORAGE MEDIUM

(71) Applicant: Sufang Liu, Shenzhen (CN)

(72) Inventors: Ming Liu, Shenzhen (CN); Tingyao Yang, Shenzhen (CN); Juxin Zhai, Shenzhen (CN); Qun Guo, Shenzhen (CN)

(73) Assignee: Sufang Liu, Shenzhen (CN)

( * ) Notice: Subject to any disclaimer, the term of this patent is extended or adjusted under 35 U.S.C. 154(b) by 66 days.

(21) Appl. No.: 17/403,983

(22) Filed: Aug. 17, 2021

(65) Prior Publication Data

US 2023/0057456 A1 Feb. 23, 2023

(51) Int. Cl.
*H04R 1/10* (2006.01)
*H04R 3/00* (2006.01)

(52) U.S. Cl.
CPC ..... *H04R 1/1016* (2013.01); *H04R 3/00* (2013.01); *H04R 2420/07* (2013.01)

(58) Field of Classification Search
CPC ..... H04R 1/1016; H04R 1/1041; G10H 2220/371; A61B 5/024; A63B 71/0686; A63B 2071/0625
See application file for complete search history.

(56) References Cited

U.S. PATENT DOCUMENTS 7,521,623 B2* 4/2009 Bowen ..... G11B 27/105 84/612
7,700,867 B2* 4/2010 Sano et al. ..... G11B 27/11 84/612
7,956,274 B2* 6/2011 Sasaki et al. ..... A63B 71/0686 84/612
8,376,911 B2* 2/2013 Ogg et al. ..... A63B 71/0686 482/148
8,608,621 B2* 12/2013 Ogg et al. ..... A63B 71/0686 482/3
9,563,268 B2* 2/2017 Smith et al. ..... A61B 5/1112
9,568,994 B2* 2/2017 Jehan ..... G06F 16/636
10,067,733 B2* 9/2018 Park ..... G10H 1/0008
10,176,255 B2* 1/2019 Kanda ..... G06F 16/63
10,735,848 B2* 8/2020 Pergament et al. .. A61B 5/0205
10,791,848 B2* 10/2020 Zufi et al. ..... A61M 21/02
10,832,643 B1* 11/2020 Trim et al. ..... A61B 5/01
11,275,350 B2* 3/2022 Stavitskii et al. .. H04L 12/2816
2008/0188354 A1* 8/2008 Pauws et al. ..... G06F 16/68 482/8

(Continued)

FOREIGN PATENT DOCUMENTS

EP 3053354 A2 8/2016
WO 2010102083 A1* 9/2010 ..... A63B 24/0062

(Continued)

OTHER PUBLICATIONS

Extended European Search Report dated Feb. 4, 2022; Appln. No. 21191607.7.

*Primary Examiner* — Ryan Robinson

(57) ABSTRACT

Disclosed are an earphone control method, an earphone control device, an earphone, and a non-transitory computer readable storage medium. The earphone control method includes obtaining a biometric parameter and/or a current environment parameter of a wearer during exercise; determining a play content and/or a light-emitting state corresponding to the biometric parameter and/or the current environment parameter; and controlling an earphone to operate according to the play content and/or the light-emitting state.

8 Claims, 5 Drawing Sheets

(56) References Cited

U.S. PATENT DOCUMENTS

| | | | | |
|---|---|---|---|---|
| 2011/0022594 | A1* | 1/2011 | Takatsuka et al. | G10H 1/40 707/E17.089 |
| 2014/0070957 | A1 | 3/2014 | Longinotti-Buitoni et al. | |
| 2016/0292270 | A1* | 10/2016 | Negi et al. | A61B 5/6817 |
| 2016/0296799 | A1 | 10/2016 | Macagnano et al. | |
| 2017/0043236 | A1* | 2/2017 | Li | B62J 45/416 |
| 2018/0110461 | A1* | 4/2018 | Yamaki et al. | A61B 5/0816 |
| 2019/0158946 | A1* | 5/2019 | Honeycutt | H04R 1/1041 |
| 2019/0246982 | A1* | 8/2019 | Mackellar et al. | A61M 21/00 |
| 2019/0350524 | A1* | 11/2019 | Hurley | A61B 5/486 |
| 2021/0311689 | A1* | 10/2021 | Kwon | G06F 3/165 |
| 2021/0407478 | A1* | 12/2021 | Fraga et al. | G06F 16/683 |
| 2022/0143484 | A1* | 5/2022 | Wang et al. | A63B 24/0075 |
| 2022/0203064 | A1* | 6/2022 | Lipot et al. | G10H 1/0033 |
| 2022/0218943 | A1* | 7/2022 | Giordano | A61B 5/11 |

FOREIGN PATENT DOCUMENTS

| | | | |
|---|---|---|---|
| WO | 2015/051113 | A2 | 4/2015 |
| WO | 2015/051113 | A3 | 7/2015 |

* cited by examiner

EARPHONE CONTROL METHOD AND DEVICE, AND NON-TRANSITORY COMPUTER READABLE STORAGE MEDIUM

TECHNICAL FIELD

The present disclosure relates to the technical field of earphone control, in particular to an earphone control method, an earphone control device, an earphone, and a non-transitory computer readable storage medium.

BACKGROUND

Nowadays, earphones have become an indispensable portable device during people's exercise. For example, most of the earphones do not have interactive functions during the process of long-distance running. When the user wears the earphones for exercise, the earphones cannot monitor the user's exercise state in real time and make corresponding prompts, resulting in a decrease in user experience.

SUMMARY

The embodiments of the present disclosure provide an earphone control method, an earphone control device, an earphone, and a non-transitory computer readable storage medium, which aims to solve the problem that the earphone cannot monitor the user's exercise state in real time and make corresponding prompts.

The present disclosure provides an earphone control method, including:

obtaining a biometric parameter and/or a current environment parameter of a wearer during exercise;

determining a play content and/or a light-emitting state corresponding to the biometric parameter and/or the current environment parameter; and controlling an earphone to operate according to the play content and/or the light-emitting state.

In an embodiment, the operation of obtaining a biometric parameter and/or a current environment parameter of a wearer during exercise includes:

obtaining the biometric parameter and/or the current environment parameter from a third-party application of a terminal device.

In an embodiment, the operation of obtaining a biometric parameter and/or a current environment parameter of a wearer during exercise includes:

obtaining the biometric parameter through a preset biosensor of the earphone, and/or obtaining the current environment parameter through a preset environment detection sensor of the earphone.

In an embodiment, the operation of determining a play content and/or a light-emitting state corresponding to the biometric parameter and/or the current environment parameter includes:

determining a change frequency corresponding to the biometric parameter and/or determining a change amplitude corresponding to the current environment parameter; and determining the play content and/or the light-emitting state according to the change frequency and/or the change amplitude.

In an embodiment, the operation of determining the play content and/or the light-emitting state according to the change frequency and/or the change amplitude includes:

determining a first light-emitting state and/or a first play content according to the change frequency.

In an embodiment, the operation of controlling the earphone to operate according to the play content and/or the light-emitting state includes:

controlling the earphone to operate according to the first light-emitting state and/or the first play content.

In an embodiment, the operation of determining the play content and/or the light-emitting state according to the change frequency and/or the change amplitude further includes:

determining a second light-emitting state and/or a second play content according to the change amplitude, wherein the first light-emitting state and the second light-emitting state have different light-emitting colors, light-emitting brightness, and/or light-emitting frequencies.

In an embodiment, the operation of controlling the earphone to operate according to the play content and/or the light-emitting state includes:

controlling the earphone to operate according to the second light-emitting state and/or the second play content.

In an embodiment, after the operation of controlling the earphone to operate according to the play content and/or the light-emitting state, the method further includes:

determining whether the change frequency of the biometric parameter and/or the change amplitude of the current environment parameter is within a preset threshold interval; and in response to a determination that the change frequency and/or the change amplitude is not within the preset threshold interval, updating the play content and/or the light-emitting state.

In order to achieve the above objective, the present disclosure further provides an earphone control device, including:

an acquisition module for obtaining a biometric parameter and/or a current environment parameter of a wearer during exercise;

a determination module for determining a play content and/or a light-emitting state corresponding to the biometric parameter and/or the current environment parameter; and a control module for controlling an earphone to operate according to the play content and/or the light-emitting state.

Besides, in order to achieve the above objective, the present disclosure further provides an earphone, including: a memory, a processor, and an earphone control program stored in the memory and executable on the processor, the earphone control program, when executed by the processor, implements the operations of the earphone control method as described above.

Besides, in order to achieve the above objective, the present disclosure further provides a non-transitory computer readable storage medium, wherein an earphone control program is stored in the non-transitory computer readable storage medium, the earphone control program, when executed by a processor, implements the operations of the earphone control method as described above.

The technical solutions of an earphone control method, an earphone control device, an earphone, and a non-transitory computer readable storage medium provided by the embodiments of the present disclosure have at least the following technical effects or advantages.

Since the technical solutions of obtaining a biometric parameter and/or a current environment parameter of a wearer during exercise; determining a play content and/or a light-emitting state corresponding to the biometric parameter and/or the current environment parameter; and controlling the earphone to operate according to the play content and/or the light-emitting state are adopted, it is possible to solve the problem that the earphone cannot monitor the user's exercise state in real time and makes corresponding prompts, thereby improving the user experience.

The realization of the objective, functional characteristics, and advantages of the present disclosure are further described with reference to the accompanying drawings.

DETAILED DESCRIPTION OF THE EMBODIMENTS

In order to better understand the above technical solutions, the exemplary embodiments of the present disclosure will be described in more detail below with reference to the accompanying drawings. Although the drawings show exemplary embodiments of the present disclosure, it should be understood that the present disclosure can be implemented in various forms and should not be limited by the embodiments set forth herein. On the contrary, these embodiments are provided to enable a more thorough understanding of the present disclosure and to fully convey the scope of the present disclosure to those skilled in the art.

It should be noted that, the descriptions associated with, e.g., "first" and "second," in the present disclosure are merely for descriptive purposes, and cannot be understood as indicating or suggesting relative importance or impliedly indicating the number of the indicated technical feature. Therefore, the feature associated with "first" or "second" can expressly or impliedly include at least one such feature.

Besides, the meaning of "and/or" appearing in the disclosure includes three parallel scenarios. For example, "A and/or B" includes only A, or only B, or both A and B. In addition, the technical solutions between the various embodiments can be combined with each other, but they must be based on the realization of those of ordinary skill in the art. When the combination of technical solutions is contradictory or cannot be achieved, it should be considered that such a combination of technical solutions does not exist, nor is it within the scope of the present disclosure.

Figure 1:
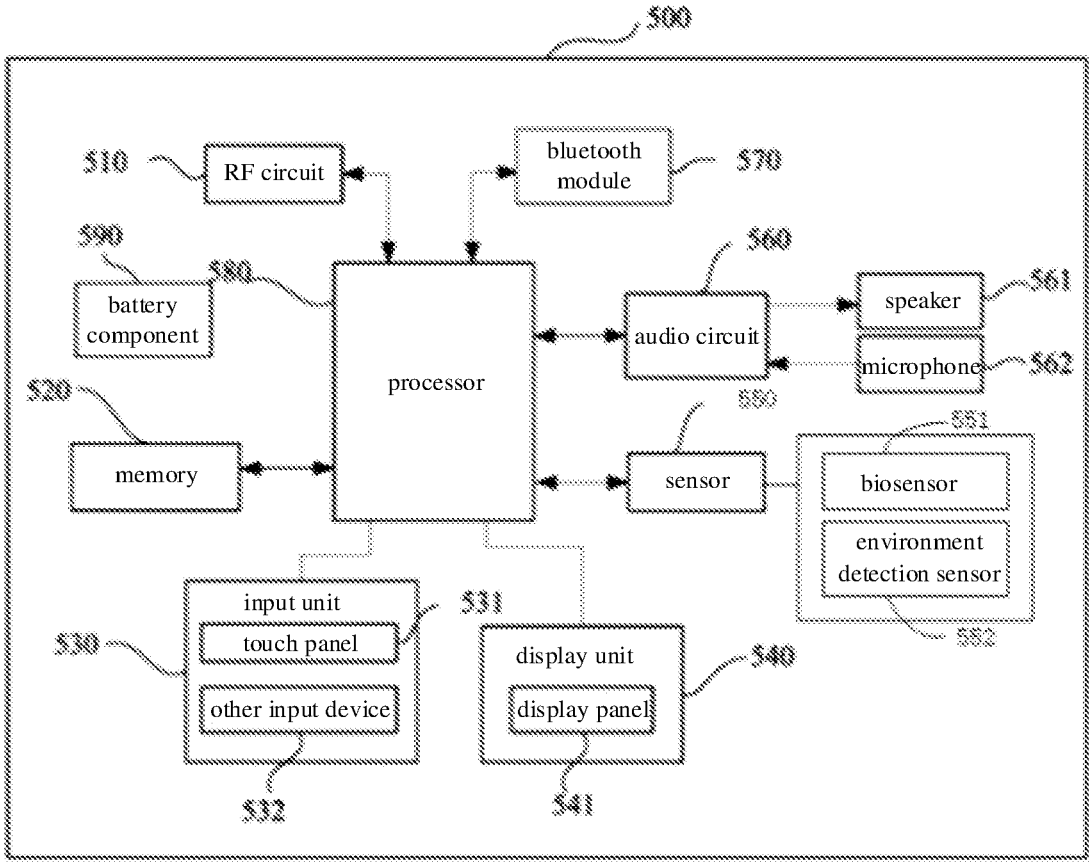
FIG. 1 is a schematic structural diagram of a hardware of an earphone of the present disclosure.

The earphone of the present disclosure may be any one of wireless earphones or wired earphones, and the earphones may also be divided according to functions, such as sports earphones, etc.. This application takes a wireless earphone as an example for description. As shown in FIG. 1, FIG. 1 is a schematic structural diagram of a hardware of an earphone of the present disclosure. The wireless earphone of the present disclosure includes an RF circuit 510, a memory 520, an input unit 530, a display unit 540, a sensor 550, an audio circuit 560, a Bluetooth module 570, a processor 580, and a battery component 590. The processor 580 can be implemented by a highly integrated chip, which integrates a Bluetooth module, a Microcontroller Unit (MCU), and a Digital Signal Processing (DSP), and can also integrate other components, which is not limited here. The Bluetooth module 570 can include dual-mode Bluetooth, namely a basic rate/enhanced data rate Bluetooth module (BR/EDR) and a Bluetooth low energy module (BLE). The MCU is mainly configured for earphone controlling, and the DSP is mainly configured for digital signal processing. Further, the wireless earphone further includes a memory 520. As a computer-readable storage medium, the memory can also include an operating system, a network communication module, and a connection switching program for the wireless earphone. The network communication module is mainly to connect a terminal and an earphone box, and communicate with the terminal and the earphone box.

Further, the audio circuit 560 includes a speaker 561 and a microphone 562. The audio signal collected by the audio circuit 560 is configured to realize the call function and realize the noise reduction function. The audio circuit 560 can include more than two speakers. For example, each earphone of the wireless earphone is equipped with two speakers that are a moving coil speaker and a moving iron speaker. The moving coil speaker has a better response in the middle and low frequencies, and the moving iron speaker has a better response in the middle and high frequencies. The two speakers are used at the same time, and the moving iron speaker is connected in parallel to the moving coil speaker through the frequency division function of the processor, so that the human ear can hear the sound waves of the entire audio frequency band. The battery component 590 is configured to power the wireless earphone. The input unit 530 of the wireless earphone includes a touch panel 531 and other input devices 532. The touch panel 531 is configured to implement a touch function, and can be a key. The display unit 540 of the wireless earphone includes a display panel 541 for displaying a biometric parameter or a current environment parameter, or for displaying play content, etc.. The sensor 550 includes a biosensor 551 and an environment detection sensor 552. The biosensor 551 can also include a heart rate sensor. The sensor can also include an acceleration sensor, a light sensor, a vibration sensor, a temperature sensor, etc.. For example, the biosensor 551 detects the biometric parameter of the user currently wearing the wireless earphone. The environment detection sensor 552 detects the current environment parameter of an environment where the user currently wearing the wireless earphone stands. The wireless earphone further includes a light-emitting component 590. The light-emitting component 590 is configured to prompt different working states, such as an exercise state prompt, a power-on prompt, a low battery prompt, a terminal connection prompt, an earphone box connection prompt, or the like.

Those skilled in the art can understand that the structure of the earphone described above does not constitute a limitation on the earphone, which may include more or less components than those shown in the figure, or a combination of certain components, or different component arrangements.

Figure 2:
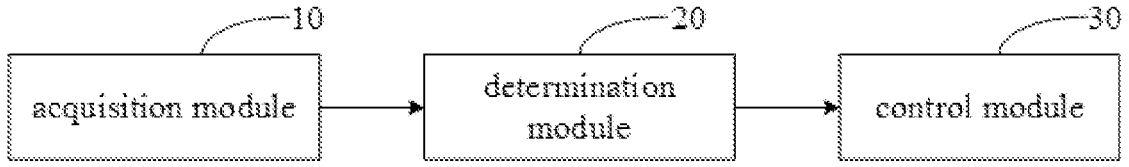
FIG. 2 is a first schematic structural diagram of an earphone control device of the present disclosure.

Based on the same inventive concept, the present disclosure further provides an earphone control device. As shown in FIG. 2, FIG. 2 is a first schematic structural diagram of the earphone control device of the present disclosure. The earphone control device includes: an acquisition module 10, a determination module 20, a control module 30, etc., each of which will be described below.

Figure 3:
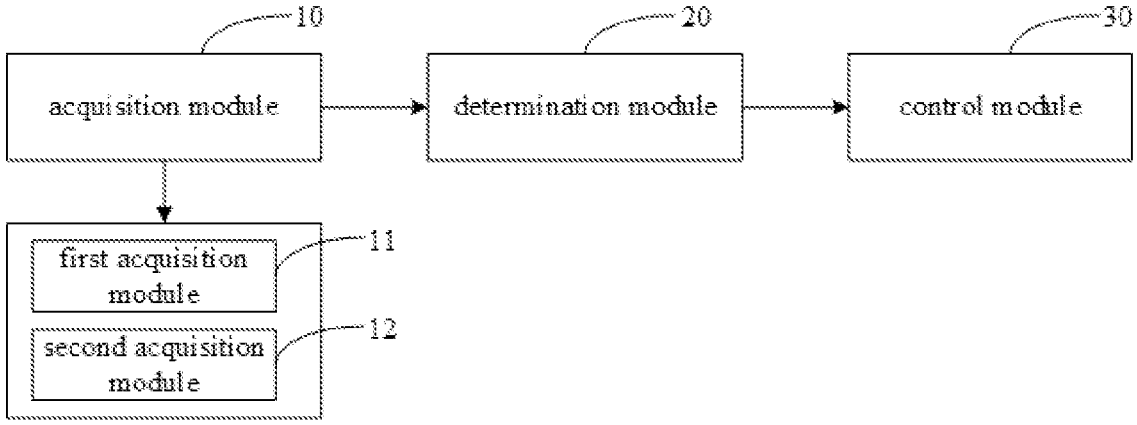
FIG. 3 is a second schematic structural diagram of the earphone control device of the present disclosure.

The acquisition module 10 is for obtaining a biometric parameter and/or a current environment parameter of a wearer during exercise. Specially, as shown in FIG. 3, FIG. 3 is a second schematic structural diagram of the earphone control device of the present disclosure. The acquisition module 10 further includes a first acquisition module 11 and a second acquisition module 12. The first acquisition module 11 is for obtaining the biometric parameter and/or the current environment parameter from a third-party application of a terminal device. The second acquisition module 12 is for obtaining the biometric parameter through a preset biosensor of the earphone, and/or obtaining the current environment parameter through a preset environment detection sensor of the earphone.

The determination module 20 is for determining a play content and/or a light-emitting state corresponding to the biometric parameter and/or the current environment parameter. Further, the determination module 20 is for determining a change frequency corresponding to the biometric parameter and/or a change amplitude corresponding to the current environment parameter, and determining the play content and/or the light-emitting state according to the change frequency and/or the change amplitude. Further, the determination module 20 is for determining a first light-emitting state and/or a first play content according to the change frequency, or determining a second light-emitting state and/or a second play content according to the change amplitude.

The control module 30 is for controlling the earphone to operate according to the play content and/or the light-emitting state. Further, the control module 30 is for controlling the earphone to operate according to the first light-emitting state and/or the first play content, or controlling the earphone to operate according to the second light-emitting state and/or the second play content.

Figure 4:
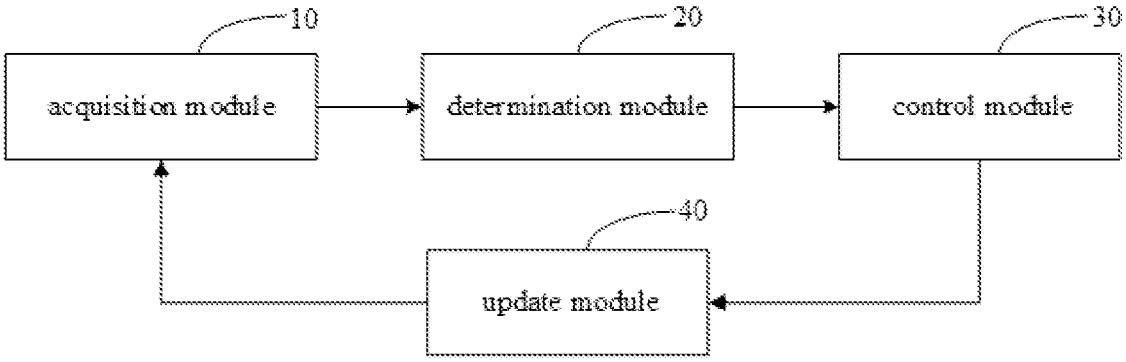
FIG. 4 is a third schematic structural diagram of the earphone control device of the present disclosure.

As shown in FIG. 4, FIG. 4 is a third schematic structural diagram of the earphone control device of the present disclosure. The earphone control device further includes an update module 40. The update module 40 is for determining whether the change frequency of the biometric parameter and/or the change amplitude of the current environment parameter is within a preset threshold interval, and when the change frequency and/or the change amplitude is not within the preset threshold interval, updating the play content and/or the light-emitting state.

The specific embodiments of the earphone control device of the present disclosure are basically the same as the embodiments of the earphone control method described above, and will not be repeated here.

In this embodiment, the earphone includes a memory, a processor, and an earphone control program stored in the memory and executable by the processor. When the processor calls the earphone control program stored in the memory, the processor performs the following operations:

obtaining a biometric parameter and/or a current environment parameter of a wearer during exercise;

determining a play content and/or a light-emitting state corresponding to the biometric parameter and/or the current environment parameter; and controlling the earphone to operate according to the play content and/or the light-emitting state.

When the processor calls the earphone control program stored in the memory, the processor further performs the following operations:

obtaining the biometric parameter and/or the current environment parameter from a third-party application of a terminal device; and/or obtaining the biometric parameter through a preset biosensor of the earphone, and/or obtaining the current environment parameter through a preset environment detection sensor of the earphone.

When the processor calls the earphone control program stored in the memory, the processor further performs the following operations:

determining a change frequency corresponding to the biometric parameter and/or determining a change amplitude corresponding to the current environment parameter; and determining the play content and/or the light-emitting state according to the change frequency and/or the change amplitude.

When the processor calls the earphone control program stored in the memory, the processor further performs the following operations:

determining a first light-emitting state and/or a first play content according to the change frequency;

the operation of controlling the earphone to operate according to the play content and/or the light-emitting state includes:

controlling the earphone to operate according to the first light-emitting state and/or the first play content.

When the processor calls the earphone control program stored in the memory, the processor further performs the following operations:

determining a second light-emitting state and/or a second play content according to the change amplitude;

the operation of controlling the earphone to operate according to the play content and/or the light-emitting state includes:

controlling the earphone to operate according to the second light-emitting state and/or the second play content.

When the processor calls the earphone control program stored in the memory, the processor further performs the following operations:

determining whether the change frequency of the biometric parameter and/or the change amplitude of the current environment parameter is within a preset threshold interval; and in response to a determination that the change frequency and/or the change amplitude is not within the preset threshold interval, updating the play content and/or the light-emitting state.

The present disclosure provides some embodiments of an earphone control method. It should be noted that although the logical sequence is shown in the flowchart, in some cases, the operations shown or described may be performed in a different order than the logical sequence described here.

Figure 6:
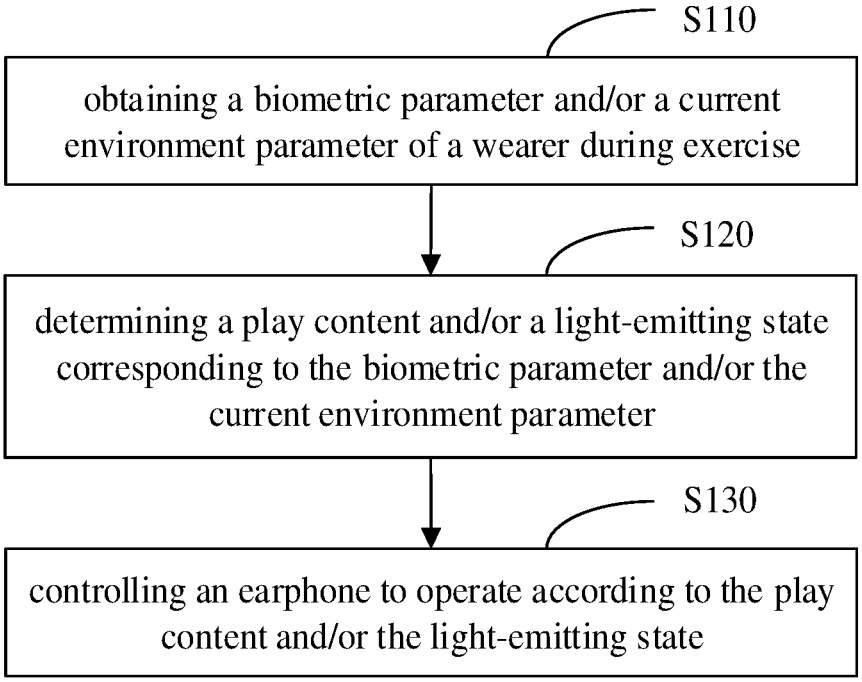
FIG. 6 is a schematic flowchart of an earphone control method according to a first embodiment of the present disclosure.

As shown in FIG. 6, in a first embodiment of the present disclosure, the earphone control method includes the following operations:

Operation S110, obtaining a biometric parameter and/or a current environment parameter of a wearer during exercise;

Operation S120, determining a play content and/or a light-emitting state corresponding to the biometric parameter and/or the current environment parameter;

Operation S130, controlling the earphone to operate according to the play content and/or the light-emitting state.

In this embodiment, in order to solve the problem of the inability to monitor the user's exercise state or physical condition in real time and make corresponding prompts during exercise, the present disclosure provides an earphone control method based on the fact that during exercise, the users usually wear earphones to relieve the pressure caused by exercise or use earphones to increase the atmosphere of exercise. The earphone can be applied in different scenes, and the play content of the earphone and the light-emitting state of the light-emitting component on the earphone are determined according to different exercise scenes. For example, during a night run, the light-emitting state of the light-emitting component on the earphone can be controlled according to the biometric parameters of the wearer; the corresponding play content can be recommended according to the biometric parameters of the wearer. For example, when the biometric parameters change slowly, light music is recommended, and when the biometric parameters change greatly, fast-paced music is recommended. When the biometric parameters exceed the preset interval, a prompt message is output to remind the wearer to slow down the exercise. The prompt message can be a voice prompt message issued through a speaker on the earphone to remind the wearer to slow down the exercise, and the prompt message can be a prompt by controlling the light-emitting state of the light-emitting component of the earphone.

In this embodiment, the earphone of the present disclosure can be a wireless earphone or a wired earphone. The wireless earphone can be a normal Bluetooth earphone or a TWS Bluetooth earphone. The earphone is provided with a sensor, such as a biometric detection sensor or an environment detection sensor, and can also include other sensors. Specially, the biometric detection sensor is configured to obtain the biometric parameters of the wearer. The biometric detection sensor includes a heart rate sensor, which is configured to detect the wearer's heart rate and monitor the wearer's exercise state. Before exercise, the heart rate threshold range can be preset, such as 90-140. During exercise, when the heart rate detection value exceeds the heart rate threshold range, the biometric detection sensor adjusts the light-emitting state of the light-emitting component of the earphone or reminds the user that the heart rate is out of the range by voice. The biometric detection sensor can also include an acceleration sensor. The acceleration sensor is configured to detect the exercise step frequency parameter of the wearer to determine the exercise speed of the wearer, and adjust the light-emitting state of the light-emitting component of the earphone according to the exercise speed, so that the light-emitting state of the light-emitting component of the earphone changes with the change of the exercise speed. The environment detection sensor is configured to obtain external environment parameters. The environment detection sensor includes a light sensor, which controls the light-emitting state of the light-emitting component of the earphone according to the ambient light of the external environment to remind the surrounding passers-by, cars, bicycles, etc. to pay attention to the wearer.

In this embodiment, before obtaining the biometric parameter and/or the current environment parameter of the wearer during exercise, it is necessary to determine the wear state of the earphone. The operation of obtaining the biometric parameter and/or the current environment parameter is stopped upon detecting that the earphone is in an unworn state. Specially, a pressure value is obtained through a pressure sensor on the earphone. The pressure sensor detects stretch and pulsation of blood vessels in the ear, and converts a stretch signal or a pulsation signal into the pressure value through a preset conversion rule, so as to determine whether the earphone is in the wearing state or in the unworn state according to the pressure value. The operation of determining the wear state of the earphone according to the pressure value includes: determining a pressure value of a left sub-earphone and/or a right sub-earphone respectively, so as to determine the wearing or unworn state of the earphone. The pressure sensor of the left sub-earphone detects the pressure value of the left sub-earphone. The pressure sensor of the right sub-earphone detects the pressure value of the right sub-earphone. Whether the pressure value of the left sub-earphone and the pressure value of the right sub-earphone are within a preset pressure interval is determined. The earphone is in the wearing state when the first pressure value and the second pressure value are within a preset pressure interval. Alternatively, whether the pressure value of the left sub-earphone or the pressure value of the right sub-earphone is within a preset pressure interval is determined. The earphone is in the wearing state when the first pressure value or the second pressure value is within the preset pressure interval. The present disclosure can also determine the unworn state of the earphone. The earphone is in the unworn state when the pressure value of the left sub-earphone and the pressure value of the right sub-earphone is not within the preset pressure interval. The way of determining the unworn state is the same as the way of determining the wearing state, and will not be repeated here.

In this embodiment, it is possible to obtain the biometric parameter of the wearer during exercise, determine the change frequency corresponding to the biometric parameter, and determine the first light-emitting state and the first play content of the earphone according to the change frequency. It is also possible to obtain environment parameter during exercise, determine a change amplitude corresponding to the environment parameter, and determine the second light-emitting state and the second play content of the earphone according to the change amplitude. It is also possible to obtain the biometric parameter and the current environment parameter of the wearer during exercise at the same time, and determine the change frequency corresponding to the biometric parameter and the change amplitude corresponding to the current environment parameters, respectively. The change frequency corresponding to the biometric parameter and the change amplitude corresponding to the current environment parameter are comprehensively processed to determine the third light-emitting state and the third play content of the earphone. The first light-emitting state, the second light-emitting state, and the third light-emitting state have different light-emitting colors, light-emitting brightness, and/or light-emitting frequencies. For example, the light-emitting state can be slow breathing, fast flashing, alternate flashing, and have different light-emitting colors and light-emitting frequencies.

Figure 5:
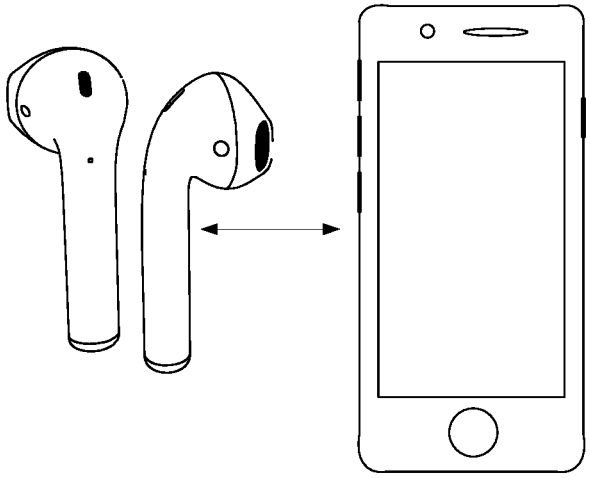
FIG. 5 is a schematic diagram of a connection between the earphone and a terminal device of the present disclosure.

In this embodiment, the biometric parameter includes but is not limited to the parameter such as heart rate and blood pressure. The biometric parameter and/or the current environment parameter can be collected through a terminal device connected to the earphone. The terminal device includes but is not limited to a smart bracelet, a smart phone or the like. For example, as shown in FIG. 5, FIG. 5 establishes a connection between the earphone and a smart phone to obtain data collected by the smart phone. It is also possible to obtain the biometric parameter and/or the current environment parameter from a third-party application by calling an interface of the third-party application in the terminal device. The third-party application includes but is not limited to: WeChat Sports, Alipay Steps, or the like. For example, the biometric parameter and/or the current environment parameter can be directly obtained through the WeChat sports interface of the WeChat APP, or can be collected by a preset sensor on the earphone. For example, the biometric parameter of the wearer can be obtained through a biometric detection sensor inside the earphone. Alternatively, the environment parameter of the external environment can be obtained through an environment detection sensor inside the earphone. No matter which method is used to obtain the biometric parameter and/or the current environment parameter, the biometric parameter and/or the current environment parameter can be processed through a preset conversion rule, so as to obtain the corresponding change frequency or change amplitude.

In this embodiment, the earphone is also provided with a light-emitting component. The light-emitting component is LED lamp. The number of the LED lamps on the light-emitting component can be set. The light-emitting component is configured to prompt different working states, such as an exercise state prompt, a power-on prompt, a low battery prompt, a terminal connection prompt, and an earphone box connection prompt. The light-emitting states of the light-emitting component corresponding to different working states are different. The light-emitting state may include light-emitting color, for example, the color may be any one of green, red, blue, or other colors. The light-emitting state can also include light-emitting brightness. The brightness include any one of low brightness, medium brightness, and high brightness, and the operating current of the light-emitting component can also be adjusted according to actual conditions to determine different brightness levels. The light-emitting state can also include light-emitting frequency, for example, any one of flashing once every half second and flashing once per second can be set. The light-emitting state may be combination of the light-emitting color, the light-emitting brightness, and the light-emitting frequency. The light-emitting state of the light-emitting component can be set according to actual conditions. For example, in the exercise state, the light-emitting state of the light-emitting component can be set as: green, medium brightness, and flashing once per second according to the change frequency corresponding to the biometric parameter. In the exercise state, the light-emitting state of the light-emitting component can be set as: red, high brightness, and flashing once every half second according to the change amplitude corresponding to the environment parameter.

By obtaining a biometric parameter and/or a current environment parameter of a wearer during exercise; determining a play content and/or a light-emitting state corresponding to the biometric parameter and/or the current environment parameter; and controlling the earphone to operate according to the play content and/or the light-emitting state, the technical solutions of this embodiment solve the problem that the earphone cannot monitor the user's exercise state in real time and makes corresponding prompts, and improves the user experience.

Figure 7:
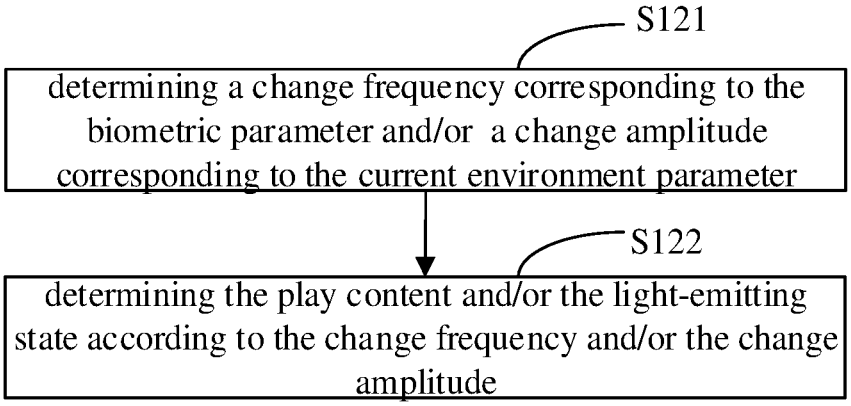
FIG. 7 is a schematic flowchart of the earphone control method according to a second embodiment of the present disclosure.

As shown in FIG. 7, in a second embodiment of the present disclosure, operation S121 to operation S122 are detailed operations of operation S120 in the first embodiment, including:

Operation S121, determining a change frequency corresponding to the biometric parameter and/or determining a change amplitude corresponding to the current environment parameter;

Operation S122, determining the play content and/or the light-emitting state according to the change frequency and/or the change amplitude.

In this embodiment, the biometric parameter is collected by the preset biosensor of the earphone, the biometric parameter is processed according to the preset rule to obtain the change frequency corresponding to the biometric parameter. The first light-emitting state of the light-emitting component of the earphone and the corresponding first play content are determined according to the change frequency. The current environment parameter is collected by the preset environment detection sensor of the earphone, the current environment parameter is processed according to the preset rule to obtain the change amplitude corresponding to the current environment parameter. The second light-emitting state of the light-emitting component of the earphone and/or the corresponding second play content is determined according to the change amplitude. During the process, the earphone itself realizes the collection of biometric parameter and/or current environment parameter, and the conversion of biometric parameter and/or current environment parameter. The earphone then determines the light-emitting state and/or play content of the earphone according to the change frequency and/or the change amplitude, and controls the operation of the earphone according to the light-emitting state and/or the play content.

In this embodiment, after obtaining the biometric parameter and/or current environment parameter of the wearer, it can be converted into the light-emitting state of different light-emitting components according to the change frequency or change amplitude. In this way, the color, brightness and light-emitting frequency of the light-emitting component can be changed with the change of the change frequency or the change of the change amplitude. The first light-emitting state is determined according to the biometric parameter of the wearer, and the second light-emitting state is determined according to the current environment parameter of the wearer. The biometric parameter and/or current environment parameter of the wearer is converted into the control signal or current signal of the light-emitting component, thereby determining the first light-emitting state or the second light-emitting state according to the control signal or current signal of the light-emitting component. When the change frequency of the biometric parameter and/or the change speed of the change amplitude of the current environment parameter is faster, the light-emitting state of the light emitting component of the corresponding earphone is faster. When the change frequency of the biometric parameter and/or the change speed of change amplitude of the current environment parameter is slower, the light-emitting state of the light-emitting component of the corresponding earphone is slower. In this way, the changing frequency and/or the light-emitting amplitude corresponds to the light-emitting state of the light-emitting component.

In technical solutions of the present disclosure, through determining a change frequency corresponding to the biometric parameter and/or determining a change amplitude corresponding to the current environment parameter and determining the play content and/or the light-emitting state according to the change frequency and/or the change amplitude, different working states and play contents of the earphone can be determined according to different changing parameters.

Figure 8:
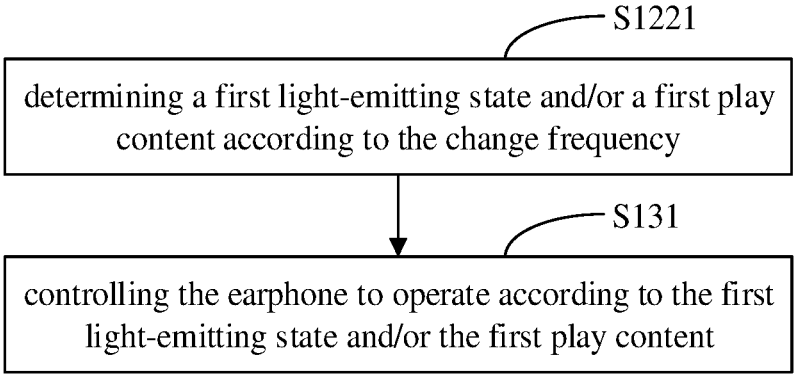
FIG. 8 is a schematic flowchart of the earphone control method according to a third embodiment of the present disclosure.

As shown in FIG. 8, in a third embodiment of the present disclosure, operation S1221 is a detailed operation of operation S122 in the second embodiment, and operation S131 is a detailed operation of operation S130 in the second embodiment.

Operation S1221, determining a first light-emitting state and/or a first play content according to the change frequency;

Operation S131, controlling the earphone to operate according to the first light-emitting state and/or the first play content.

In this embodiment, controlling the light-emitting component of the earphone to operate in the first light-emitting state is controlled not only by the earphone itself, but also by the terminal device connected to the earphone. By obtaining the biometric parameter and/or the current environment parameter from the third-party application of the terminal device, or directly obtaining the biometric parameter and/or the current environment parameter collected by the terminal device, the terminal device processes the acquired biometric parameter to determine the change frequency corresponding to the biometric parameter, and then the terminal device processes the change frequency to obtain the first light-emitting state of the light-emitting component of the earphone and recommend the corresponding first play content. The first light-emitting state of the light-emitting component of the earphone is converted into a control signal according to a preset conversion rule, and the control signal is sent to the earphone through the network. After receiving the control signal, the earphone controls the light-emitting component to operate in the first light-emitting state according to the control signal, and/or automatically matches the corresponding first play content according to the change frequency. The first play content may be music, or may be content such as weather forecast.

In this embodiment, through determining a first light-emitting state and/or a first play content according to the change frequency and controlling the earphone to operate according to the first light-emitting state and/or the first play content, it is possible to determine different light-emitting states and recommend different play contents in different work scenarios.

Figure 9:
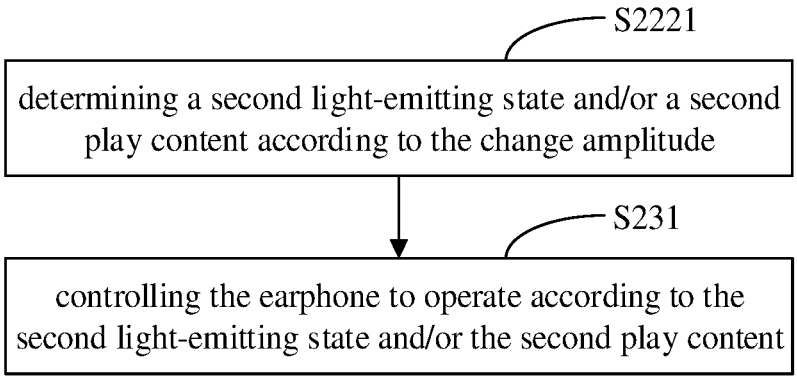
FIG. 9 is a schematic flowchart of the earphone control method according to a fourth embodiment of the present disclosure.

As shown in FIG. 9, in a fourth embodiment of the present disclosure, operation S2221 is a detailed operation of operation S122 in the second embodiment, and operation S231 is a detailed operation of operation S130 in the second embodiment.

Operation S2221, determining a second light-emitting state and/or a second play content according to the change frequency;

Operation S231, controlling the earphone to operate according to the second light-emitting state and/or the second play content.

In this embodiment, the terminal device processes the acquired current environment parameter to determine the change amplitude corresponding to the current environment parameter. The terminal device then processes the change amplitude to obtain the second light-emitting state of the light-emitting component of the earphone and recommend the corresponding second play content. The second light-emitting state of the light-emitting component of the earphone is converted into a control signal according to a preset conversion rule, and the control signal is sent to the earphone through the network. After receiving the control signal, the earphone controls the light-emitting component to operate in the second light-emitting state according to the control signal, and/or automatically matches the corresponding second play content according to the change amplitude. The second play content may be music, or may be content such as weather forecast.

In technical solutions of this embodiment, through determining a second light-emitting state and/or a second play content according to the change amplitude and controlling the earphone to operate according to the second light-emitting state and/or the second play content, it is possible to determine different light-emitting states and recommend different play contents in different work scenarios.

Figure 10:
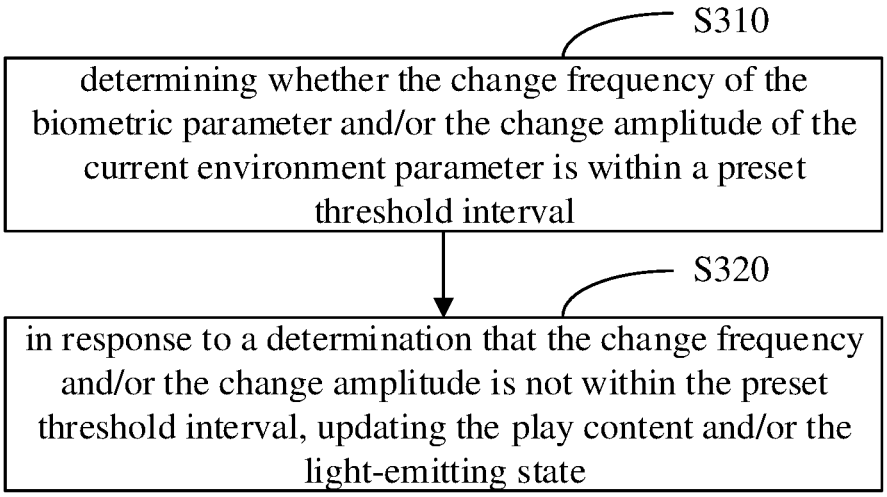
FIG. 10 is a schematic flowchart of the earphone control method according to a fifth embodiment of the present disclosure.

As shown in FIG. 10, in a fifth embodiment of the present disclosure, operation S310 to operation S320 are after operation S130 in the first embodiment.

Operation S310, determining whether the change frequency of the biometric parameter and/or the change amplitude of the current environment parameter is within a preset threshold interval;

Operation S320, in response to a determination that the change frequency and/or the change amplitude is not within the preset threshold interval, updating the play content and/or the light-emitting state.

In this embodiment, during exercise, whether the change frequency of the biometric parameter and/or the change amplitude of the current environment parameter is within the preset threshold interval is determined, when the change frequency and/or the change amplitude is not within the preset threshold interval, it is possible to control the light-emitting component of the earphone to update the light-emitting state and/or the play content according to different changing frequencies and/or changing amplitudes. Specially, before exercise, whether the change frequency of the biometric parameter and/or the change amplitude of the environment parameter is within the preset threshold interval can be determined by timing of the system clock inside the earphone. A duration of the change frequency and/or change amplitude of the earphone not within the preset threshold interval is obtained. When the duration of the change frequency and/or the change amplitude not within the preset threshold interval exceeds a preset duration, the play content and/or the light-emitting state of the light-emitting component of the earphone is updated.

In this embodiment, through determining whether the change frequency of the biometric parameter and/or the change amplitude of the current environment parameter is within a preset threshold interval and when the change frequency and/or the change amplitude is not within the preset threshold interval, updating the play content and/or the light-emitting state, it is possible to update the play content and/or the light-emitting state when the change frequency and/or the change amplitude changes.

Based on the same inventive concept, an embodiment of the present disclosure also provides a non-transitory computer readable storage medium. The non-transitory computer readable storage medium stores an earphone control program. When the earphone control program is executed by a processor, each operation of the earphone control method as described above is implemented, and the same technical effect can be achieved, which won't be repeated here to avoid repetition.

Since the non-transitory computer readable storage medium provided by the embodiment of the present disclosure is a non-transitory computer readable storage medium used to implement the method of the embodiment of the present disclosure, based on the method introduced in the embodiment of the present disclosure, those skilled in the art can understand the specific structure and deformation of the storage medium, which will not be repeated here. All non-transitory computer readable storage medium used in the methods of the embodiments of the present disclosure belong to the scope of the present disclosure.

Those skilled in the art should understand that the embodiments of the present disclosure can be provided as a method, a system, or a computer program product. Therefore, the present disclosure may adopt the form of a complete hardware embodiment, a complete software embodiment, or an embodiment combining software and hardware. Moreover, the present disclosure may adopt the form of a computer program product implemented on one or more computer-usable storage media (including but not limited to disk storage, CD-ROM, optical storage, etc.) containing computer-usable program codes.

The present disclosure is described with reference to flowcharts and/or block diagrams of methods, devices (systems), and computer program products according to embodiments of the present disclosure. It should be understood that each process and/or block in the flowchart and/or block diagram, and the combination of processes and/or blocks in the flowchart and/or block diagram can be realized by computer program instructions. These computer program instructions can be provided to the processor of a general-purpose computer, a special-purpose computer, an embedded processor or other programmable data processing equipment to produce a machine, such that the instructions executed by the processor of the computer or other programmable data processing equipment generate means for implementing the functions specified in one or more processes in the flowchart and/or one or more blocks in the block diagram.

These computer program instructions can also be stored in a computer-readable memory that can guide a computer or other programmable data processing equipment to work in a specific manner, so that the instructions stored in the computer-readable memory produce an article of manufacture including the instruction device. The instruction device realizes the functions specified in one or more processes in the flowchart and/or one or more blocks in the block diagram.

These computer program instructions can also be loaded on a computer or other programmable data processing equipment, so that a series of operation steps are executed on the computer or other programmable equipment to produce computer-implemented processing. Thereby, the instructions executed on the computer or other programmable devices provide steps for implementing the functions specified in one or more processes in the flowchart and/or one or more blocks in the block diagram.

It should be noted that in the claims, any reference signs located between parentheses should not be constructed as limitations on the claims. The word "comprising" does not exclude the presence of parts or operations not listed in the claims. The word "a" or "an" preceding a component does not exclude the presence of multiple such components. The present disclosure can be implemented by means of hardware comprising several different components and by means of a suitably programmed computer. In the unit claims enumerating several devices, several of these devices may be embodied in the same hardware item. The use of the words first, second, and third, etc. do not indicate any order. These words can be interpreted as names.

Although the embodiments of the present disclosure have been described, those skilled in the art can make additional changes and modifications to these embodiments once they learn the basic creative concept. Therefore, the appended claims are intended to be interpreted as including the embodiments and all changes and modifications falling within the scope of the present disclosure.

Obviously, those skilled in the art can make various changes and modifications to the present disclosure without departing from the spirit and scope of the present disclosure. In this way, if these modifications and variations of the present disclosure fall within the scope of the claims of the present disclosure and their equivalent technologies, the present disclosure is also intended to include these modifications and variations.

What is claimed is:

1. An earphone control method, comprising operations of:

obtaining a biometric parameter and/or a current environment parameter of a wearer during exercise;

determining a play content and/or a light-emitting state corresponding to the biometric parameter and/or the current environment parameter; and controlling an earphone to operate according to the play content and/or the light-emitting state;

wherein the operation of determining the play content and/or the light-emitting state corresponding to the biometric parameter and/or the current environment parameter comprises:

determining a change frequency corresponding to the biometric parameter and/or determining a change amplitude corresponding to the current environment parameter; and determining the play content and/or the light-emitting state according to the change frequency and/or the change amplitude;

wherein the operation of determining the play content and/or the light-emitting state according to the change frequency and/or the change amplitude comprises:

determining a first light-emitting state and/or a first play content according to the change frequency;

wherein the operation of controlling the earphone to operate according to the play content and/or the light-emitting state comprises:

converting the first light-emitting state of the light-emitting component of the earphone into a control signal according to a preset conversion rule; and controlling the light-emitting component to operate in the first light-emitting state according to the control signal, and automatically matching the corresponding first play content to play according to the change frequency.

2. The earphone control method of claim 1, wherein the operation of obtaining a biometric parameter and/or a current environment parameter of a wearer during exercise comprises:

obtaining the biometric parameter and/or the current environment parameter from a third-party application of a terminal device.

3. The earphone control method of claim 1, wherein the operation of obtaining a biometric parameter and/or a current environment parameter of a wearer during exercise comprises:

obtaining the biometric parameter through a preset biosensor of the earphone, and/or obtaining the current environment parameter through a preset environment detection sensor of the earphone.

4. The earphone control method of claim 1, wherein the operation of determining the play content and/or the light-emitting state according to the change frequency and/or the change amplitude further comprises:

determining a second light-emitting state and/or a second play content according to the change amplitude, wherein the first light-emitting state and the second light-emitting state have different light-emitting colors, light-emitting brightness, and/or light-emitting frequencies.

5. The earphone control method of claim 4, wherein the operation of controlling the earphone to operate according to the play content and/or the light-emitting state comprises:

controlling the earphone to operate according to the second light-emitting state and/or the second play content.

6. The earphone control method of claim 1, wherein after the operation of controlling the earphone to operate according to the play content and/or the light-emitting state, the method further comprises:

determining whether the change frequency of the biometric parameter and/or the change amplitude of the current environment parameter is within a preset threshold interval; and in response to a determination that the change frequency and/or the change amplitude is not within the preset threshold interval, updating the play content and/or the light-emitting state.

7. An earphone, comprising: a memory, a processor, and an earphone control program stored in the memory and executable on the processor, the earphone control program, when executed by the processor, implements operations of the earphone control method of claim 1.

8. A non-transitory computer readable storage medium, wherein an earphone control program is stored in the non-transitory computer readable storage medium, the earphone control program, when executed by a processor, implements operations of the earphone control method of claim 1.

* * * * *